US008539773B2

(12) United States Patent
Ziminsky et al.

(10) Patent No.: US 8,539,773 B2
(45) Date of Patent: Sep. 24, 2013

(54) PREMIXED DIRECT INJECTION NOZZLE FOR HIGHLY REACTIVE FUELS

(75) Inventors: Willy Steve Ziminsky, Simpsonville, SC (US); Thomas Edward Johnson, Greer, SC (US); Benjamin Paul Lacy, Greer, SC (US); William David York, Greer, SC (US); Jong Ho Uhm, Simpsonville, SC (US); Baifang Zuo, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 648 days.

(21) Appl. No.: 12/365,382

(22) Filed: Feb. 4, 2009

(65) Prior Publication Data

US 2010/0192581 A1 Aug. 5, 2010

(51) Int. Cl.
*F23R 3/30* (2006.01)
*F23R 3/32* (2006.01)

(52) U.S. Cl.
USPC ..... 60/737; 60/740; 60/742; 60/746

(58) Field of Classification Search
USPC ..... 60/737, 740, 742, 746, 747, 39.463; 239/251; 138/177, 178
See application file for complete search history.

(56) References Cited

U.S. PATENT DOCUMENTS 4,100,733 A * 7/1978 Striebel et al. ..... 60/39.463
4,262,482 A * 4/1981 Roffe et al. ..... 60/736
4,429,527 A 2/1984 Teets
4,490,171 A * 12/1984 Suzuki et al. ..... 75/460
4,845,952 A * 7/1989 Beebe ..... 60/737
5,000,004 A * 3/1991 Yamanaka et al. ..... 60/723
5,193,346 A 3/1993 Kuwata et al.
5,199,265 A 4/1993 Borkowicz
5,235,814 A * 8/1993 Leonard ..... 60/738
5,247,797 A * 9/1993 Fric et al. ..... 60/737
5,259,184 A 11/1993 Borkowicz et al.
5,263,325 A 11/1993 McVey et al.
5,277,022 A * 1/1994 Shekleton et al. ..... 60/804
5,339,635 A 8/1994 Iwai et al.
5,400,968 A 3/1995 Sood
5,490,378 A 2/1996 Berger et al.
5,518,697 A 5/1996 Dalla Betta et al.
5,575,146 A 11/1996 Borkowicz et al.
5,590,529 A 1/1997 Joshi et al.
5,657,632 A 8/1997 Foss
5,680,766 A 10/1997 Joshi et al.
5,685,139 A 11/1997 Mick et al.
5,778,676 A 7/1998 Joshi et al.
5,865,030 A 2/1999 Matsuhama
5,881,756 A * 3/1999 Abbasi et al. ..... 137/9

(Continued)

*Primary Examiner* — William H Rodriguez
*Assistant Examiner* — Carlos A Rivera
(74) *Attorney, Agent, or Firm* — Cantor Colburn LLP

(57) ABSTRACT

A fuel/air mixing tube for use in a fuel/air mixing tube bundle is provided. The fuel/air mixing tube includes an outer tube wall extending axially along a tube axis between an inlet end and an exit end, the outer tube wall having a thickness extending between an inner tube surface having a inner diameter and an outer tube surface having an outer tube diameter. The tube further includes at least one fuel injection hole having a fuel injection hole diameter extending through the outer tube wall, the fuel injection hole having an injection angle relative to the tube axis. The invention provides good fuel air mixing with low combustion generated NOx and low flow pressure loss translating to a high gas turbine efficiency, that is durable, and resistant to flame holding and flash back.

18 Claims, 7 Drawing Sheets

(56) References Cited

U.S. PATENT DOCUMENTS

| | | | | |
|---|---|---|---|---|
| 5,930,999 | A | 8/1999 | Howell et al. | |
| 5,943,866 | A * | 8/1999 | Lovett et al. | 60/737 |
| 6,019,596 | A | 2/2000 | Knopfel et al. | |
| 6,174,160 | B1 * | 1/2001 | Lee et al. | 431/11 |
| 6,301,899 | B1 * | 10/2001 | Dean et al. | 60/737 |
| 6,363,724 | B1 | 4/2002 | Bechtel et al. | |
| 6,438,961 | B2 | 8/2002 | Tuthill et al. | |
| 6,442,939 | B1 * | 9/2002 | Stuttaford et al. | 60/737 |
| 6,453,673 | B1 | 9/2002 | Bechtel et al. | |
| 6,623,267 | B1 * | 9/2003 | Golladay, Jr. | 431/285 |
| 6,672,073 | B2 | 1/2004 | Wiebe | |
| 6,681,578 | B1 | 1/2004 | Bunker | |
| 6,895,755 | B2 | 5/2005 | Steinthorsson et al. | |
| 6,993,916 | B2 | 2/2006 | Johnson et al. | |
| 7,007,477 | B2 | 3/2006 | Widener | |
| 7,107,772 | B2 * | 9/2006 | Chen et al. | 60/737 |
| 7,185,494 | B2 | 3/2007 | Ziminsky et al. | |
| 7,237,384 | B2 * | 7/2007 | Stuttaford et al. | 60/776 |
| 7,412,833 | B2 | 8/2008 | Widener | |
| 7,506,510 | B2 | 3/2009 | Thomson | |
| 7,540,154 | B2 | 6/2009 | Tanimura et al. | |
| 7,556,031 | B2 | 7/2009 | Russell | |
| 7,610,759 | B2 * | 11/2009 | Yoshida et al. | 60/737 |
| 7,707,833 | B1 | 5/2010 | Bland et al. | |
| 7,886,991 | B2 | 2/2011 | Zuo et al. | |
| 8,007,274 | B2 * | 8/2011 | Johnson et al. | 431/40 |
| 2003/0010032 | A1 * | 1/2003 | Stuttaford et al. | 60/737 |
| 2005/0050895 | A1 * | 3/2005 | Dorr et al. | 60/737 |
| 2007/0062197 | A1 | 3/2007 | Hannum et al. | |
| 2008/0078160 | A1 * | 4/2008 | Kraemer et al. | 60/204 |
| 2009/0229269 | A1 | 9/2009 | Lacy et al. | |
| 2009/0241508 | A1 | 10/2009 | Davis, Jr. et al. | |
| 2009/0249789 | A1 | 10/2009 | Zuo et al. | |
| 2010/0008179 | A1 | 1/2010 | Lacy et al. | |
| 2010/0031662 | A1 | 2/2010 | Zuo | |
| 2010/0101229 | A1 | 4/2010 | York et al. | |
| 2010/0139280 | A1 * | 6/2010 | Lacy et al. | 60/737 |
| 2010/0192579 | A1 * | 8/2010 | Boardman et al. | 60/737 |
| 2010/0192581 | A1 | 8/2010 | Ziminsky et al. | |
| 2010/0218501 | A1 * | 9/2010 | York et al. | 60/737 |
| 2010/0263383 | A1 | 10/2010 | York et al. | |
| 2010/0287937 | A1 | 11/2010 | Thatcher et al. | |
| 2011/0057056 | A1 | 3/2011 | Ziminsky et al. | |
| 2012/0011854 | A1 | 1/2012 | Khan et al. | |

* cited by examiner

PREMIXED DIRECT INJECTION NOZZLE FOR HIGHLY REACTIVE FUELS

FEDERAL RESEARCH STATEMENT

This invention was made with Government support under Contract No. DE-FC26-05NT42643, awarded by the Department of Energy. The Government has certain rights in the invention.

BACKGROUND OF THE INVENTION

The subject matter disclosed herein relates to premixed direct injection nozzles and more particularly to a direct injection nozzle having good mixing, flame holding and flash back resistance.

The primary air polluting emissions usually produced by gas turbines burning conventional hydrocarbon fuels are oxides of nitrogen, carbon monoxide, and unburned hydrocarbons. It is well known in the art that oxidation of molecular nitrogen in air breathing engines is highly dependent upon the maximum hot gas temperature in the combustion system reaction zone. One method of controlling the temperature of the reaction zone of a heat engine combustor below the level at which thermal NOx is formed is to premix fuel and air to a lean mixture prior to combustion.

There are several problems associated with dry low emissions combustors operating with lean premixing of fuel and air. That is, flammable mixtures of fuel and air exist within the premixing section of the combustor, which is external to the reaction zone of the combustor. Typically, there is some bulk burner tube velocity, above which a flame in the premixer will be pushed out to a primary burning zone. However, certain fuels such as hydrogen or syngas have a high flame speed, particularly when burned in a pre-mixed mode. Due to the high turbulent flame velocity and wide flammability range, premixed hydrogen fuel combustion nozzle design is challenged by flame holding and flashback at reasonable nozzle pressure loss. Diffusion hydrogen fuel combustion using direct fuel injection methods inherently generates high NOx.

With natural gas as the fuel, premixers with adequate flame holding margin may usually be designed with reasonably low air-side pressure drop. However, with more reactive fuels, such as high hydrogen fuel, designing for flame holding margin and target pressure drop becomes a challenge. Since the design point of state-of-the-art nozzles may approach 3000 degrees Fahrenheit bulk flame temperature, flashback into the nozzle could cause extensive damage to the nozzle in a very short period of time.

BRIEF DESCRIPTION OF THE INVENTION

The present invention is a premixed direct injection nozzle design that provides good fuel air mixing with low combustion generated NOx and low flow pressure loss translating to a high gas turbine efficiency. The invention is durable and resistant to flame holding and flash back.

According to one aspect of the invention, a fuel/air mixing tube for use in a fuel/air mixing tube bundle is provided. The fuel/air mixing tube includes an outer tube wall extending axially along a tube axis between an inlet end and an exit end, the outer tube wall having a thickness extending between an inner tube surface having an inner diameter and an outer tube surface having an outer tube diameter.

The tube further includes at least one fuel injection hole having a fuel injection hole diameter extending through the outer tube wall, the fuel injection hole having an injection angle relative to the tube axis, the injection angle being generally in the range of 20 to 90 degrees. The fuel injection hole is located at a recession distance from the exit end along the tube axis, the recession distance being generally in the range of about 5 to about 100 times greater than the fuel injection hole diameter, depending on geometric constraints, the reactivity of fuel, and the NOx emissions desired.

According to another aspect of the invention, a fuel/air mixing tube for use in a fuel/air mixing tube bundle is provided. It includes an outer tube wall extending axially along a tube axis between an inlet end and an exit end, the outer tube wall having a thickness extending between an inner tube surface having a inner diameter and an outer tube surface having an outer tube diameter. It further includes at least one fuel injection hole having a fuel injection hole diameter extending through the outer tube wall, the fuel injection hole having an injection angle relative to the tube axis, the inner diameter of said inner tube surface being generally from about 4 to about 12 times greater than the fuel injection hole diameter.

According to yet another aspect of the invention, a method of mixing high hydrogen fuel in a premixed direct injection nozzle for a turbine combustor is provided. The method comprises providing a plurality of mixing tubes attached together to form the nozzle, each of the plurality of tubes extending axially along a flow path between an inlet end and an exit end, each of the plurality of tubes including an outer tube wall extending axially along a tube axis between said inlet end and said exit end, the outer tube wall having a thickness extending between an inner tube surface having a inner diameter and an outer tube surface having an outer tube diameter.

The method further provides for injecting a first fluid into the plurality of mixing tubes at the inlet end; injecting a high-hydrogen or syngas fuel into the mixing tubes through a plurality of injection holes at angle generally in the range of about 20 to about 90 degrees relative to said tube axis; and mixing the first fluid and the high-hydrogen or syngas fuel to a mixedness of about 50% to about 95% fuel and first fluid mixture at the exit end of the tubes.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
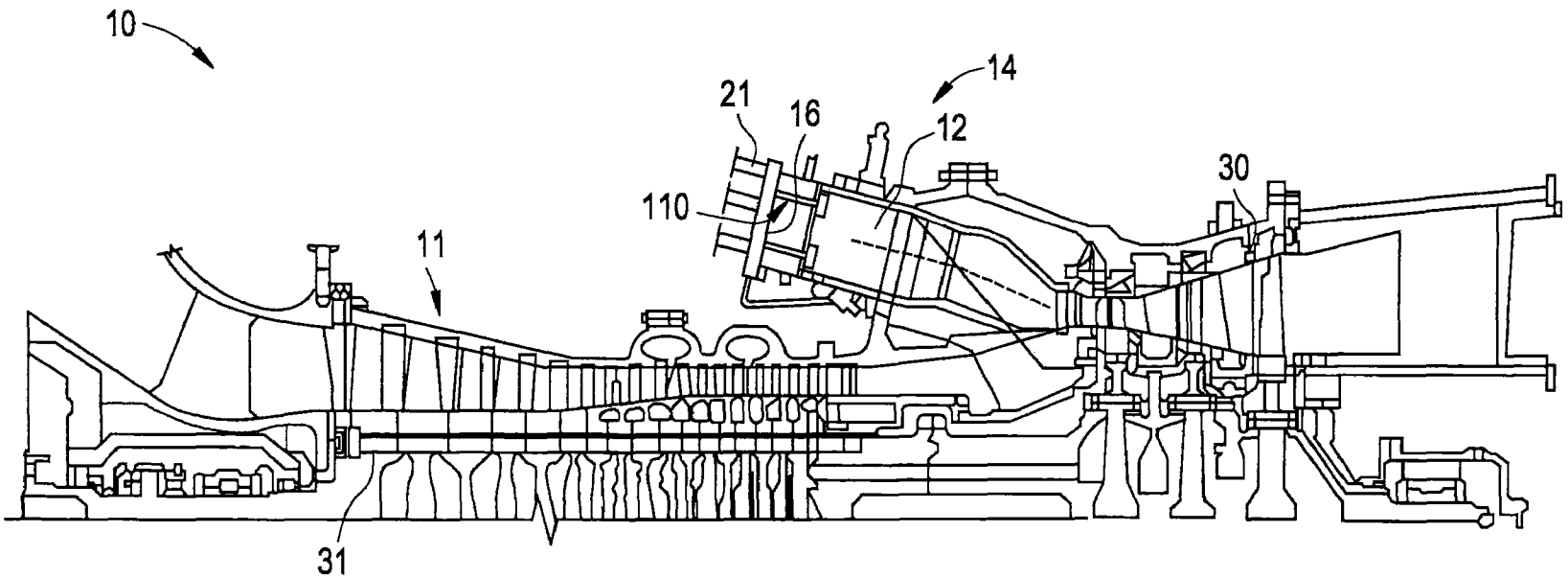
FIG. 1 is a cross-section of a gas turbine engine, including the location of injection nozzles in accordance with the present invention.

Referring now to FIG. 1 where the invention will be described with reference to specific embodiments, without limiting same, a schematic illustration of an exemplary gas turbine engine 10 is shown. Engine 10 includes a compressor 11 and a combustor assembly 14. Combustor assembly 14 includes a combustor assembly wall 16 that at least partially defines a combustion chamber 12. A pre-mixing apparatus or nozzle 110 extends through combustor assembly wall 16 and leads into combustion chamber 12. As will be discussed more fully below, nozzle 110 receives a first fluid or fuel through a fuel inlet 21 and a second fluid or compressed air from compressor 11. The fuel and compressed air are then mixed, passed into combustion chamber 12 and ignited to form a high temperature, high pressure combustion product or gas stream. Although only a single combustor assembly 14 is shown in the exemplary embodiment, engine 10 may include a plurality of combustor assemblies 14. In any event, engine 10 also includes a turbine 30 and a compressor/turbine shaft 31. In a manner known in the art, turbine 30 is coupled to, and drives shaft 31 that, in turn, drives compressor 11.

In operation, air flows into compressor 11 and is compressed into a high pressure gas. The high pressure gas is supplied to combustor assembly 14 and mixed with fuel, for example process gas and/or synthetic gas (syngas), in nozzle 110. The fuel/air or combustible mixture is passed into combustion chamber 12 and ignited to form a high pressure, high temperature combustion gas stream. Alternatively, combustor assembly 14 can combust fuels that include, but are not limited to natural gas and/or fuel oil. Thereafter, combustor assembly 14 channels the combustion gas stream to turbine 30 which coverts thermal energy to mechanical, rotational energy.

Figure 2:
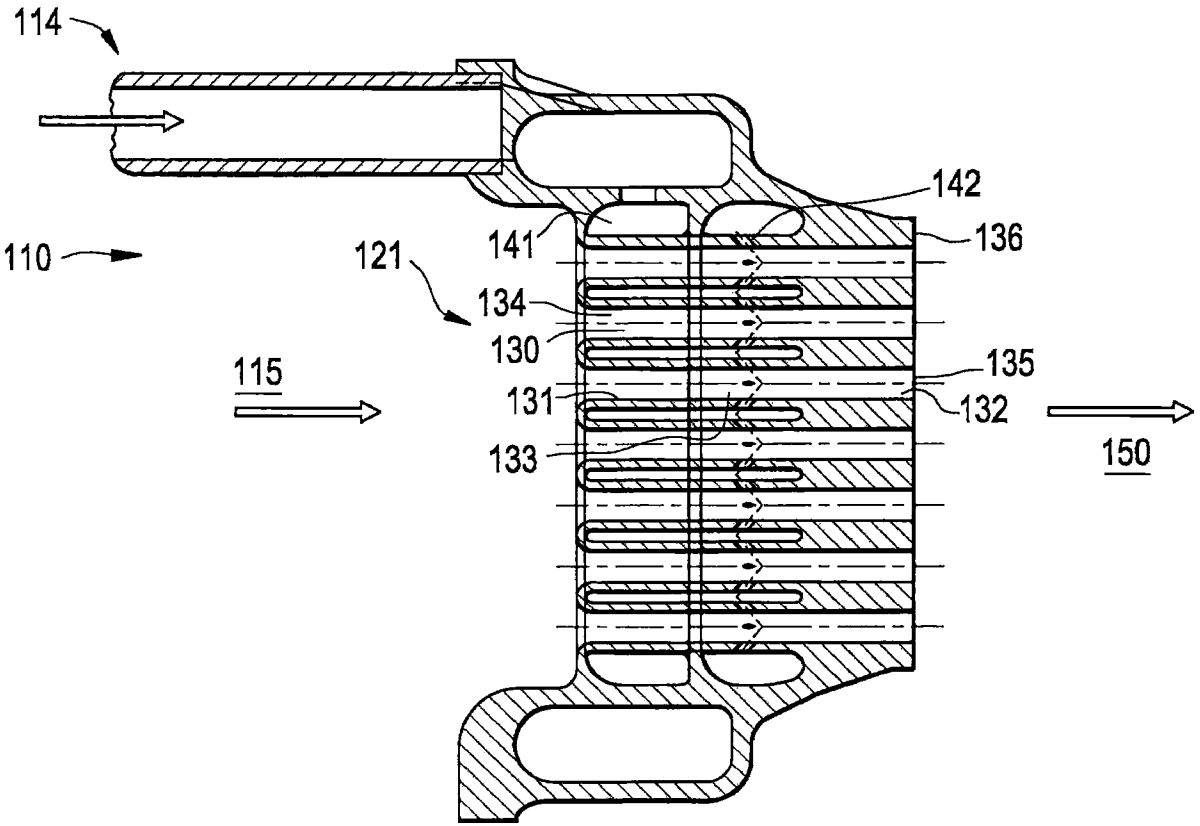
FIG. 2 is an embodiment of an injection nozzle in accordance with the present invention.
Figure 3:
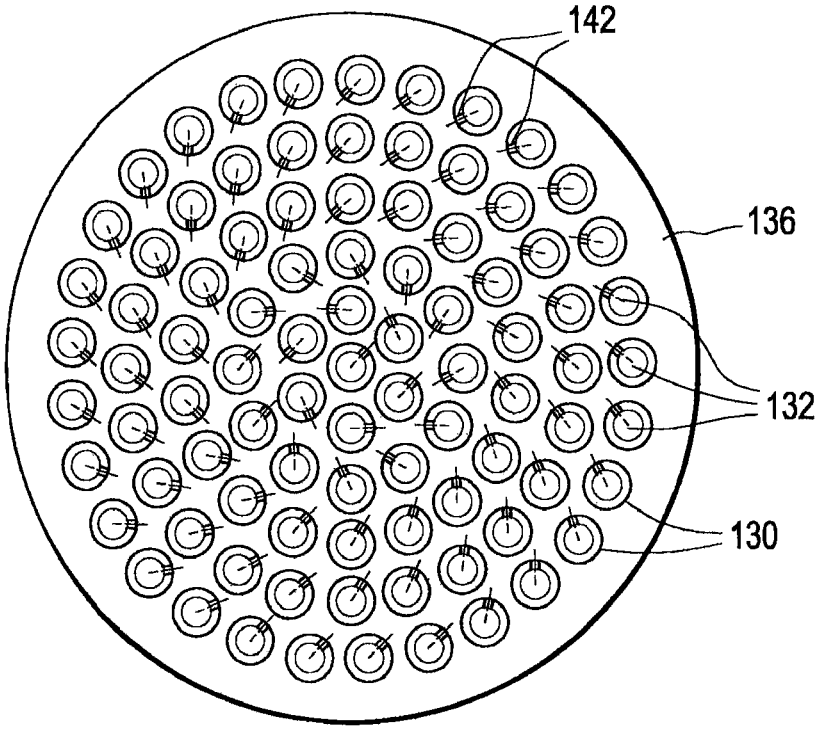
FIG. 3 is an end view of the nozzle of FIG. 2.

Referring now to FIGS. 2 and 3, a cross-section through a fuel injection nozzle 110 is shown. Nozzle 110 is connected to a fuel flow passage 114 and an interior plenum space 115 to receive a supply of air from compressor 11. A plurality of fuel/air mixing tubes is shown as a bundle of tubes 121. Bundle of tubes 121 is comprised of individual fuel/air mixing tubes 130 attached to each other and held in a bundle by end cap 136 or other conventional attachments. Each individual fuel/air mixing tube 130 includes a first end section 131 that extends to a second end section 132 through an intermediate portion 133. First end section 131 defines a first fluid inlet 134, while second end section 132 defines a fluid outlet 135 at end cap 136.

Fuel flow passage 114 is fluidly connected to fuel plenum 141 that, in turn, is fluidly connected to a fluid inlet 142 provided in the each of the plurality of individual fuel/air mixing tubes 130. With this arrangement, air flows into first fluid inlet 134, of tubes 130, while fuel is passed through fuel flow passage 114, and enters plenum 141 surrounding individual tubes 130. Fuel flows around the plurality of fuel/air mixing tubes 130 and passes through individual fuel injection inlets (or fuel injection holes) 142 to mix with the air within tubes 130 to form a fuel/air mixture. The fuel/air mixture passes from outlet 135 into an ignition zone 150 and is ignited therein, to form a high temperature, high pressure gas flame that is delivered to turbine 30.

Figure 4:
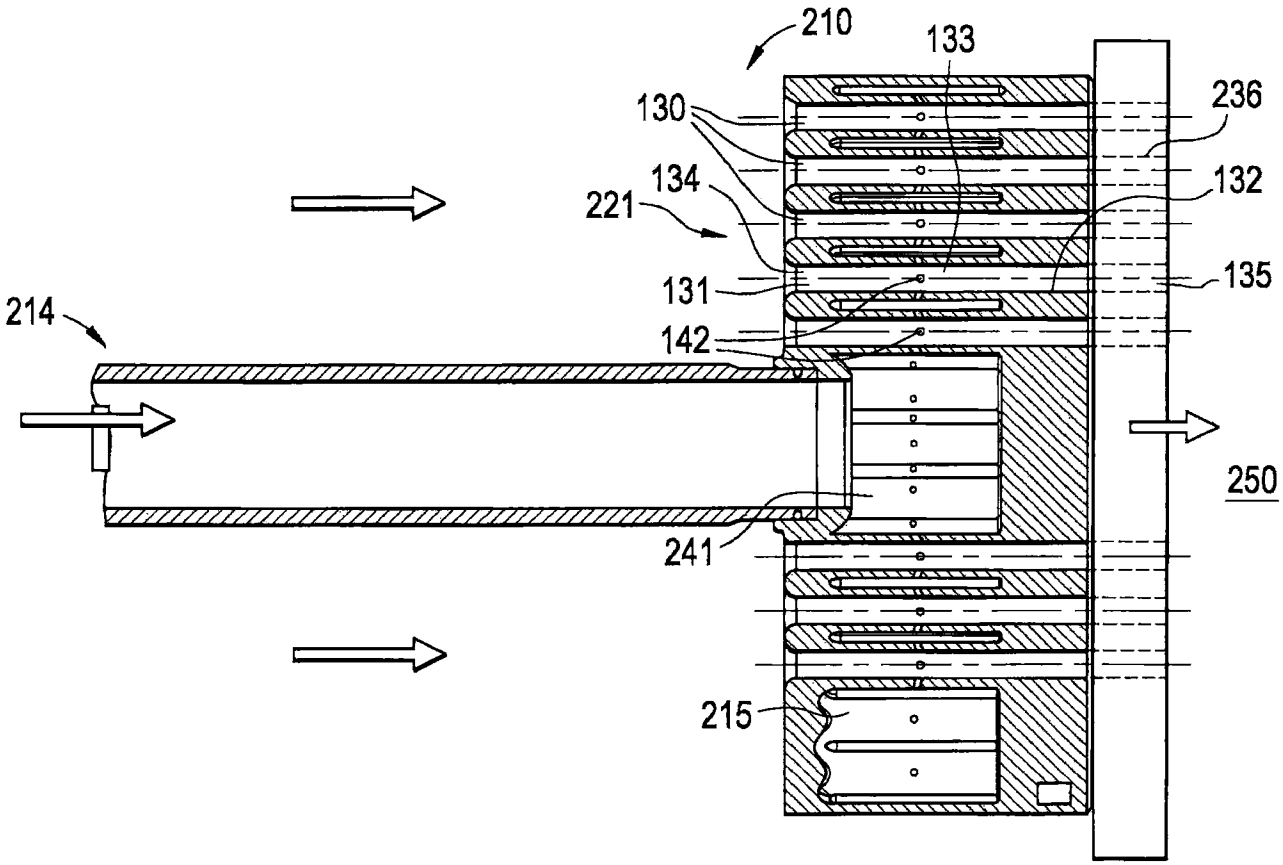
FIG. 4 is an alternative embodiment of an injection nozzle in accordance with the present invention.
Figure 5:
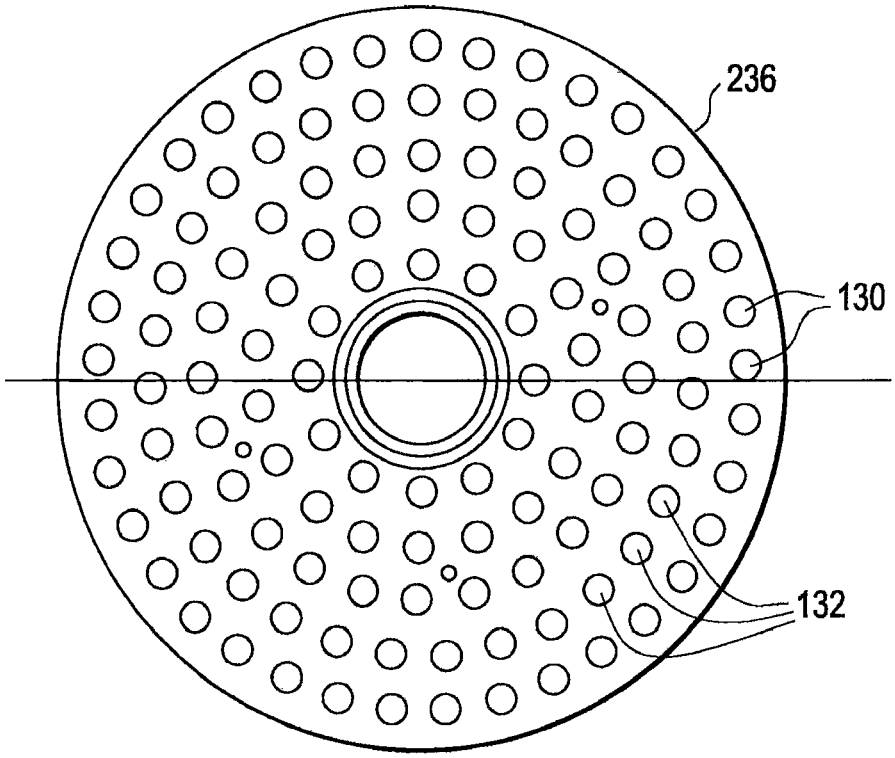
FIG. 5 is an end view of the nozzle of FIG. 4.

Referring now to FIGS. 4 and 5, a cross-section through an alternative fuel injection nozzle 210 is shown. Nozzle 210 is connected to a fuel flow passage 214 and an interior plenum space 215 to receive a supply of air from compressor 11. A plurality of fuel/air mixing tubes is shown as a bundle of tubes 221. Bundle of tubes 221 is comprised of the same individual fuel/air mixing tubes 130 identified in FIGS. 2 and 3, and are attached to each other and held in a bundle by end cap 236 or other conventional attachments. Each individual fuel/air mixing tube 130 includes a first end section 131 that extends to a second end section 132 through an intermediate portion 133. First end section 131 defines a first fluid inlet 134, while second end section 132 defines a fluid outlet 135 at end cap 236.

Fuel flow passage 214 is fluidly connected to fuel plenum 241 that, in turn, is fluidly connected to the fluid inlets 142 provided in the each of the plurality of individual fuel/air mixing tubes 130. With this arrangement, air flows into first fluid inlet 134, of tubes 130, while fuel is passed through fuel flow passage 214, and enters plenum 241, which is fluidly connected to individual tubes 130 via fluid inlets 142. Fuel flows around the plurality of fuel/air mixing tubes 130 and passes through individual fuel injection inlets (or fuel injection holes) 142 to mix with the air within tubes 130 to form a fuel/air mixture. The fuel/air mixture passes from outlet 135 into an ignition zone 250 and is ignited therein, to form a high temperature, high pressure gas flame that is delivered to turbine 30.

Referring now to FIGS. 2 through 5, in full load operations for low NOx, the flame should reside in ignition zone 150, 250. However, the use of high hydrogen/syngas fuels has made flashback a difficulty and often a problem. In order to avoid any flame holding inside the mixing tubes 130, the heat release inside the mixing tube from the flame holding should be less than the heat loss to the tube wall. This criterion puts constraints on the tube size, fuel jet penetration, and fuel jet recession distance. In principal, long recession distance gives better fuel/air mixing. If the ratio of fuel to air in mixing tubes 130, referred to herein as the mixedness of the fuel is high, and fuel and air achieve close to 100% mixing, it produces a relatively low NOx output, but is susceptible to flame holding and/or flame flashback within the nozzle 110, 210 and the individual mixing tubes 130. The individual fuel/air mixing tubes 130 of tube bundle 121, 221 may require replacement due to the damage sustained. Accordingly, as further described, the fuel/air mixing tubes 130 of the present invention creates a mixedness that sufficiently allows combustion in an ignition zone 150, 250 while preventing flashback into fuel/air mixing tubes 130. The unique configuration of mixing tubes 130 makes it possible to burn high-hydrogen or syngas fuel with relatively low NOx, without significant risk of flame holding and flame flashback from ignition zone 150, 250 into tubes 130.

Figure 6:
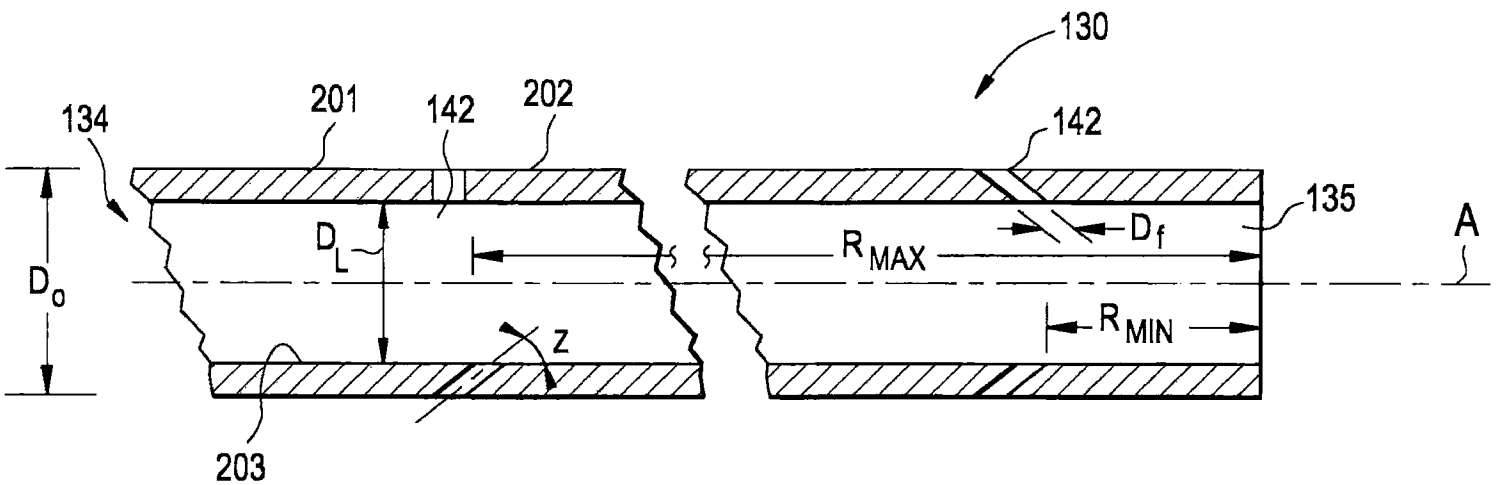
FIG. 6 is a partial cross-section of a fuel/air mixing tube in accordance with the present invention.
Figure 7:
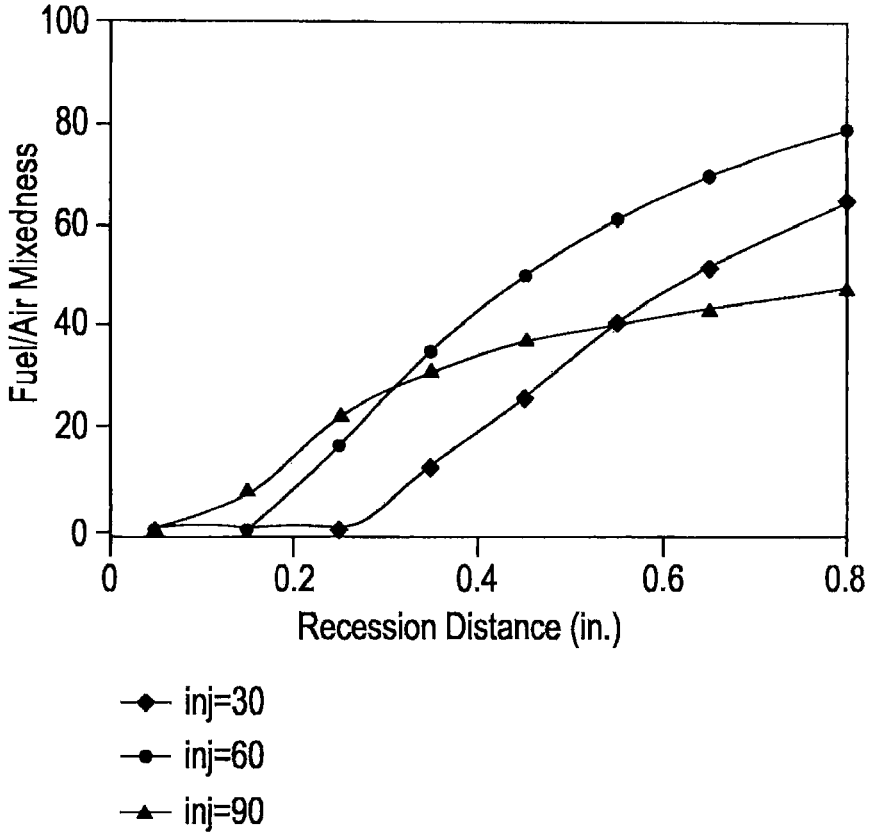
FIG. 7 is an example of a fuel/air mixedness method in accordance with the present invention.

Referring now to FIGS. 6 and 7, a fuel/air mixing tube 130 from tube bundle 121 or 221 is shown. Tube 130 includes an outer tube wall 201 having an outer circumferential surface 202 and an inner circumferential surface 203 extending axially along a tube axis A between a first fluid inlet 134 and a fluid outlet 135. Outer circumferential surface 202 has an outer tube diameter $D_o$ while inner circumferential surface 203 has an inner tube diameter $D_i$. As shown, tube 130 has a plurality of fuel injection inlets 142, each having a fuel injection hole diameter $D_f$ extending between the outer circumferential surface 202 and inner circumferential surface 203. In a non-limiting embodiment, fuel injection hole diameter $D_f$ is generally equal to or less than about 0.03 inches. In another non-limiting embodiment, the inner tube diameter $D_i$ is generally from about 4 to about 12 times greater than the fuel injection hole diameter $D_f$.

The fuel injection inlets 142 have an injection angle Z relative to tube axis A which, as shown in FIG. 6 is parallel to axis A. As shown in FIG. 6, each of injection inlets 142 has an injection angle Z generally in the range of about 20 to about 90 degrees. Further refinement of the invention has found an injection angle being generally between about 50 to about 60 degrees is desirable with certain high-hydrogen fuels. Fuel injection inlets 142 are also located a certain distance, known as the recession distance R, upstream of the tube fluid outlet 135. Recession distance R is generally in the range of about 5 ($R_{min}$) to about 100 ($R_{max}$) times greater than the fuel injection hole diameter $D_f$, while, as described above, fuel injection hole diameter $D_f$ is generally equal to or less than about 0.03 inches. In practice, the recession distance R for hydrogen/syngas fuel is generally equal to or less than about 1.5 inches and the inner tube diameter $D_i$ is generally in the range of about 0.05 to about 0.3 inches. Further refinement has found recession distance R in the range of about 0.3 to about 1 inch, while the inner tube diameter $D_i$ is generally in the range of about 0.08 to about 0.2 inches to achieve the desired mixing and target NOx emission. Some high hydrogen/syngas fuels work better below an inner tube diameter $D_i$ of about 0.15 inches. Further refinement of the invention has found an optimal recession distance being generally proportional to the burner tube velocity, the tube wall heat transfer coefficient, the fuel blow-off time, and inversely proportional to the cross flow jet height, the turbulent burning velocity, and the pressure.

The diameter $D_f$ of fuel injection inlet 142 should be generally equal to or less than about 0.03 inches, while each of tubes 130 are about 1 to about 3 inches in length for high reactive fuel, such as hydrogen fuel, and have generally about 1 to about 8 fuel injection inlets 142. For low reactive fuel, such as natural gas, each of the tubes 130 can be as long as about one foot in length. Multiple fuel injection inlets 142, i.e. about 2 to about 8 fuel injection inlets with low pressure drop is also contemplated. With the stated parameters, it has been found that a fuel injection inlet 142 having an angle Z of about 50 to about 60 degrees works well to achieve the desired mixing and target NOx emissions. It will be appreciated by one skilled in the art that a number of different combinations of the above can be used to achieve the desired mixing and target NOx emissions. For instance, when there are a plurality of fuel injection inlets 142 in a single tube 130, some injection inlets may have differing injection angles Z, as shown in FIG. 6, that e.g. vary as a function of the recession distance R. As another example, the injection angles Z may vary as a function of the diameter $D_f$ of fuel injection inlets 142, or in combination with diameter $D_f$ and recession distance R of fuel injection inlets 142. The objective is to obtain adequate mixing while keeping the length of tubes 130 as short as possible and having a low pressure drop (i.e., less than about 5%) between fluid inlet end 134 and fluid outlet end 135.

The parameters above can also be varied based upon fuel compositions, fuel temperature, air temperature, pressure and any treatment to inner and outer circumferential walls 202 and 203 of tubes 130. Performance is enhanced when the inner circumferential surface 203, through which the fuel/air mixture flows, is honed smooth regardless of the material used. It is also possible to protect nozzle 110, end cap 136, 236 which is exposed to ignition zone 150, 250 and the individual tubes 130 by cooling with fuel, air or other coolants. Finally, end cap 136, 236 may be coated with ceramic coatings or other layers of high thermal resistance.

Referring now to FIG. 7, an example of mixing a high hydrogen/syngas fuel in a recessed injection nozzle is shown. Specifically, a desired mixing of low NOx emission (below 5 ppm) and low nozzle pressure loss (below 3%) is achieved, when the recession distance R of the fuel injection inlets 142 in the non-limiting example shown is about 0.6 to about 0.8 inches from the fluid outlet 135. As described above, recession distance R may vary from generally about 1 to about 50 times greater than the fuel injection hole diameter. As can be seen, in the non-limiting embodiments shown, three fuel injection angles are shown, 30 degrees, 60 degrees and 90 degrees but, as described above, may vary generally in the range of about 20 to about 90 degrees. By the time the fuel/air mixture reaches fluid outlet 135, fuel/air mixedness is at almost 80% with an injection angle Z at about 60 degrees, between 60% and 70% with an injection angle Z at about 30 degrees, while fuel/air mixedness is at about 50% with an injection angle Z of 90 degrees.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel injection nozzle comprising;

a plurality of fuel/air mixing tubes configured as a bundle of tubes, each of said tubes including an outer tube wall extending axially along a tube axis between an inlet end and an exit end, said outer tube wall having a thickness extending between an inner tube surface having an inner diameter and an outer tube surface having an outer tube diameter;

each of said tubes including at least one fuel injection hole having a fuel injection hole diameter extending through said outer tube wall, at a location between said inlet end and said exit end, said fuel injection hole having an injection angle relative to said tube axis, said injection angle being in the range of about 30 to about 80 degrees to reduce flame holding and flash back from a highly reactive gaseous fuel entering the fuel injection nozzle, said inner diameter of said inner tube surface being from about 4 to about 12 times greater than said fuel injection hole diameter; and a recession distance extending between said fuel injection hole and said exit end along said tube axis, said recession distance being about 1 to about 100 times greater than said fuel injection hole diameter.

2. The fuel/air mixing nozzle of claim 1, wherein said fuel injection hole diameter is about equal to or less than about 0.03 inches.

3. A method of mixing a highly reactive gaseous fuel in a premixed direct injection nozzle for a turbine combustor, said method comprising;

providing a plurality of mixing tubes configured as a bundle of tubes and attached together to form said nozzle, each of said plurality of tubes extending axially along a flow path between an inlet end and an exit end, each of said plurality of tubes including an outer tube wall extending axially along a tube axis between said inlet end and said exit end, said outer tube wall having a thickness extending between an inner tube surface having an inner diameter and an outer tube surface having an outer tube diameter;

injecting a first fluid into said plurality of mixing tubes at said inlet ends; and mitigating flame holding and flash back inside the premixed direct injection nozzle of the turbine comprising:

injecting a high-hydrogen gaseous fuel or a gaseous synthetic fuel into said mixing tubes through a plurality of injection holes at angle in the range of about 30 to about 80 degrees relative to said tube axis; and mixing said first fluid and said high hydrogen fuel or synthetic gas to a mixedness of greater than about 50% fuel and first fluid mixture at said exit end of said tubes.

4. The method of claim 3, wherein said mixing provides a mixedness from about 50% to about 95% fuel and first fluid mixture at said exit end of said tubes.

5. The method of claim 3, wherein said mixing provides a mixedness occurring at a location between about 0.6 to about 0.8 inches downstream of said fuel injection holes.

6. The method of claim 3, wherein the plurality of injection holes for injecting the high-hydrogen fuel or synthetic gas into said mixing tubes comprises about 1 to about 8 fuel injection holes per tube.

7. The method of mixing of claim 3, wherein said injection angle is about 30 to about 60 degrees.

8. A fuel/air mixing tube for use with highly reactive fuels in a fuel/air mixing tube bundle comprising;

an outer tube wall extending axially along a tube axis between an inlet end and an exit end, said outer tube wall having a thickness extending between an inner tube surface having a inner diameter and an outer tube surface having an outer tube diameter;

at least one fuel injection hole having a fuel injection hole diameter extending through said outer tube wall, at a location between said inlet end and said exit end, said fuel injection hole having an injection angle relative to said tube axis, said injection angle being in the range of about 30 to about 80 degrees;

a recession distance extending between said fuel injection hole and said exit end along said tube axis, said recession distance being about 5 to about 100 times greater than said fuel injection hole diameter, including a plurality of fuel injection holes, wherein said injection angle of said at least one fuel injection holes differs from at least one other of said plurality of fuel injection holes.

9. The fuel/air mixing tube of claim 8, wherein said different injection angles are configured to vary as a function of said recession distance.

10. The fuel/air mixing tube of claim 8, including a plurality of fuel injection holes, wherein said at least one fuel injection hole has a diameter that is different than at least one other of said plurality of fuel injection holes.

11. The fuel/air mixing tube of claim 10, wherein said different fuel injection hole diameters are configured to vary as a function of said recession distance.

12. The fuel/air mixing tube of claim 8, wherein said recession distance is equal to or less than about 1.5 inches and said inner tube diameter is in the range of about 0.05 to about 0.3 inches.

13. The fuel/air mixing tube of claim 8, wherein the recession distance is in the range of about 0.3 to about 1 inches and said inner tube diameter is in the range of about 0.05 to about 0.3 inches.

14. The fuel/air mixing tube of claim 8, comprising a plurality of fuel injection holes having a plurality of fuel injection hole diameters.

15. The fuel/air mixing tube of claim 8, comprising a plurality of fuel injection holes having a plurality of fuel injection hole angles.

16. The fuel/air mixing tube of claim 15, wherein said plurality of fuel injection holes comprises about 2 to about 8 fuel injection holes.

17. The fuel/air mixing tube of claim 8, wherein said injection angle is about 30 to about 60 degrees.

18. A fuel/air mixing tube for use with highly reactive fuels in a fuel/air mixing tube bundle comprising;

an outer tube wall extending axially along a tube axis between an inlet end and an exit end, said outer tube wall having a thickness extending between an inner tube surface having a inner diameter and an outer tube surface having an outer tube diameter;

at least one fuel injection hole having a fuel injection hole diameter extending through said outer tube wall, at a location between said inlet end and said exit end, said fuel injection hole having an injection angle relative to said tube axis, said injection angle being in the range of about 30 to about 80 degrees;

a recession distance extending between said fuel injection hole and said exit end along said tube axis, said recession distance being about 5 to about 100 times greater than said fuel injection hole diameter, including a plurality of fuel injection holes, wherein said injection angle of said at least one fuel injection holes differs from at least one other of said plurality of fuel injection holes and wherein said at least one fuel injection hole has a diameter that is different than at least one other of said plurality of fuel injection holes and wherein said injection angle of said at least one fuel injection hole is configured to vary as a function of said diameter of said fuel injection hole.

* * * * *